United States Patent [19]

Rossini

[11] Patent Number: 4,703,677

[45] Date of Patent: Nov. 3, 1987

[54] VARIABLE LENGTH SOCKET EXTENSION AND SCREWDRIVER

[76] Inventor: James L. Rossini, P.O. Box 1614, Oakdale, Calif. 95361

[21] Appl. No.: 858,165

[22] Filed: May 1, 1986

[51] Int. Cl.[4] ..... B25B 23/153

[52] U.S. Cl. ..... 81/471; 81/177.2; 81/168

[58] Field of Search ..... 81/177.2, 168, 165, 81/155, 166, 169, 167, 467, 471; 403/118, 342, 343

[56] References Cited

U.S. PATENT DOCUMENTS

| | | | |
|---|---|---|---|
| 643,268 | 2/1900 | Hallner | 81/167 |
| 3,015,246 | 1/1962 | Buyer | 81/167 |
| 3,191,486 | 6/1965 | Gibbens | 81/471 |
| 4,102,375 | 7/1978 | Rossini | 81/177.2 |

FOREIGN PATENT DOCUMENTS

| | | | |
|---|---|---|---|
| 46-26195 | 6/1971 | Japan | 81/471 |

*Primary Examiner*—Frederick R. Schmidt
*Assistant Examiner*—Bradley I. Vaught
*Attorney, Agent, or Firm*—Fleit, Jacobson, Cohn & Price

[57] ABSTRACT

A variable length tool in the form of a socket extension, screwdriver or other type of tool or tool holder which includes an externally threaded adjustable shaft having an unthreaded portion to prevent removal of the adjustable shaft from the tool. The body of the tool or tool holder is broached only at the end having an adjustment nut or screw for ease of manufacture and to enable some flexing and bending to a slight degree to eliminate critical alignment problems. In some instances, an adapter having a shear-type retaining pin is provided for over torque protection. The adjustment nut or screw is attached to the body of the tool or tool holder by rolling a portion thereof into an angled groove in the body to form a permanent connection and eliminating the need for a retaining ring and angled surfaces are provided between the tool holder or tool and the interior of the adjustment nut or screw to provide larger bearing surfaces and ease of alignment.

11 Claims, 11 Drawing Figures

VARIABLE LENGTH SOCKET EXTENSION AND SCREWDRIVER

BACKGROUND OF THE INVENTION

1. Field of the Invention

The present invention generally relates to a variable length tool in the form of a socket extension, screwdriver or other type of tool or tool holder which includes an externally threaded adjustable shaft having an unthreaded portion to prevent removal of the adjustable shaft from the tool. The body of the tool or tool holder is broached only at the end having an adjustment nut or screw for ease of manufacture and to enable some flexing and bending to a slight degree to eliminate critical alignment problems. In some instances, an adapter having a shear-type retaining pin is provided for over torque protection. The adjustment nut or screw is attached to the body of the tool or tool holder by rolling a portion thereof into an angled groove in the body to form a permanent connection and eliminating the need for a retaining ring and angled surfaces are provided between the tool holder or tool and the interior of the adjustment nut or screw screw to provide larger bearing surfaces and ease of alignment.

2. Information Disclosure Statement

My prior U.S. Pat. No. 4,102,375 issued July 25, 1978 for VARIABLE LENGTH TOOL HOLDER discloses the basic structure that has been improved with the improvements being disclosed in this application. The prior are of record in the aforementioned patent is also made of record herein but does not disclose the improvements disclosed and claimed in this application.

SUMMARY OF THE INVENTION

An object of the present invention is to provide a socket extension, screwdriver or other tool or tool holder with a variable length by utilizing a threaded shaft of polygonal configuration movably received within a tubular body having an adjustment nut or screw rotatably mounted at the free end thereof for threaded engagement with the shaft for varying the overall effective length of the tubular body and shaft with the outer end of the threaded shaft including a structure for supporting and holding various tools such as but not limited to a socket of a selected size and shape, screwdriver bits, nut drivers, magnetic tool holders and the like with the threaded shaft including an unthreaded inner end portion which will preclude the shaft from becoming disassembled from the body by continuing to rotate the adjustment nut or screw.

Another object of the invention is to provide a tool in accordance with the preceding object in which the outer end portion of the tubular body is broached to define polygonal surfaces engaging correspondingly shaped surfaces on the shaft to allow a slight degree of flexing and bending of the tool and eliminating critical alignment problems which exist when the body is broached its entire length.

A further object of the invention is to provide a tool or tool holder in accordance with the preceding object in which the adjustment nut or screw is connected to the tubular body by rolling a portion of the adjustment nut or screw into an angled groove in the exterior of the tubular body to provide a permanent rotatable connection between the tubular body and the adjustment nut or screw.

Still another object of the invention is to provide an adapter used in certain arrangements such as on the socket extension with the adapter interconnecting the tubular body and the drive output of a ratchet wrench or the like with a shear retaining pin being provided between the adapter and tubular body to protect against over torque.

A still further object of the invention is to provide a tool and tool holder including but not limited to a socket extension or a screwdriver which is quickly, easily and securely varied as to effective length and which is easy to manufacture and relatively inexpensive but yet long lasting and dependable.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figures 1, 2, 3, 4, 5:
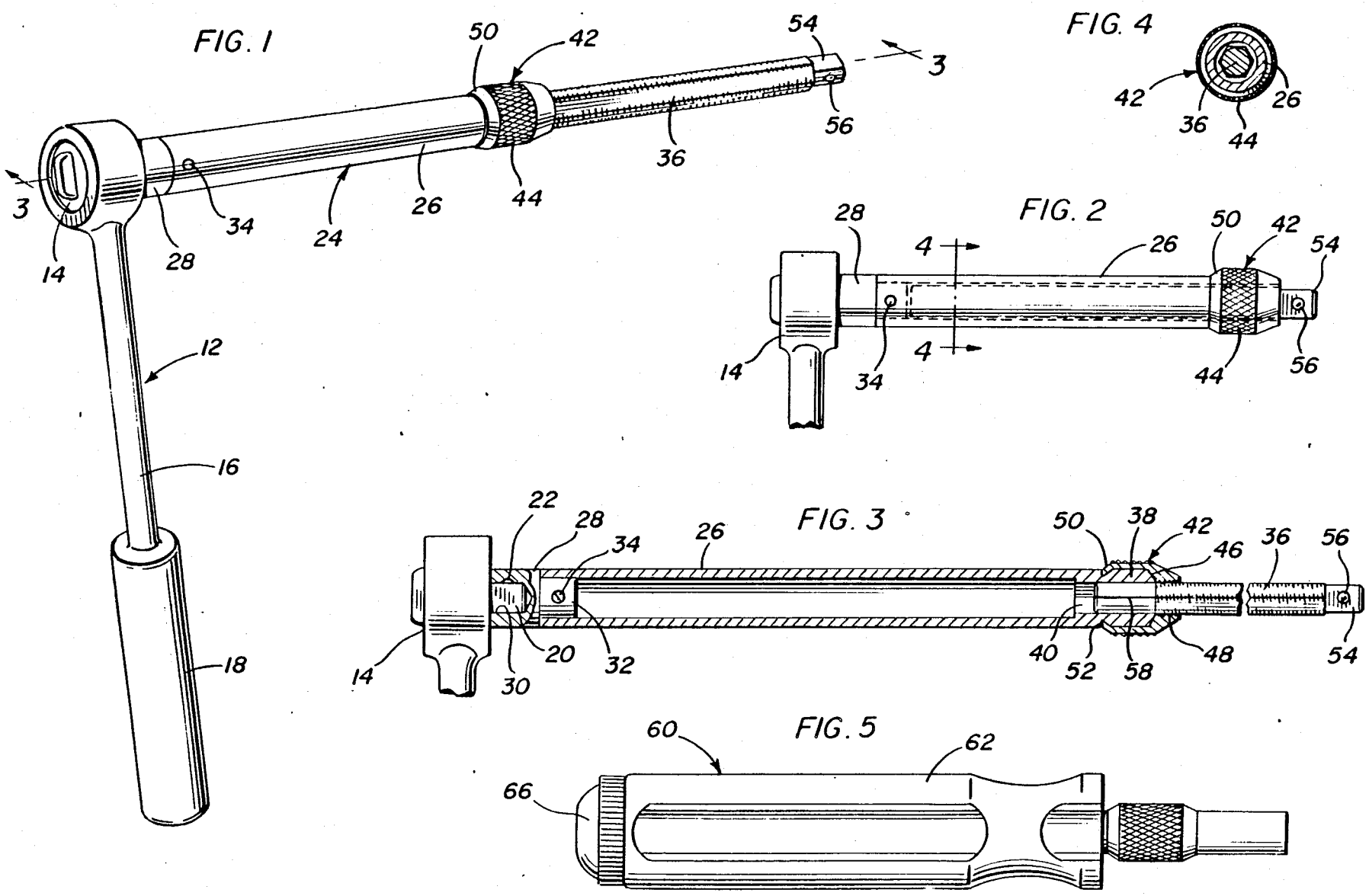
FIG. 1 is a perspective view of a socket wrench having a socket extension incorporated thereon with the variable length tool holder of the present invention incorporated therein along with an adapter between the wrench output and socket extension.
FIG. 2 is a side elevational view of a portion of the assembly of FIG. 1 in which the adjustable shaft is completely retracted.
FIG. 3 is a longitudinal, sectional view taken substantially upon a plane passing along section line 3—3 on FIG. 1 illustrating specific structural details of the components of the invention.
FIG. 4 is a transverse, sectional view taken substantially upon a plane passing along section line 4—4 on FIG. 2 illustrating further structural details and relationships of the tubular body and threaded shaft.
FIG. 5 is a side elevational view of a screwdriver utilizing the variable length feature of the present invention.

Referring now specifically to FIGS. 1–4, one embodiment of the present invention is disclosed in combination with a conventional ratchet wrench 12 which includes the usual ratchet head 14, handle 16, handgrip 18 and square output drive 20 from the ratchet head 14 with a spring detent 22 being provided to normally support and retain a selected size socket or socket extension thereon having a female socket adapted to receive the square output drive 20 and provided with a recess to receive the detent 22. The above-mentioned structure of the ratchet wrench 12 is totally conventional.

In the present invention, the socket extension 24 is in the form of a tubular, cylindrical body 26 receiving and connected to an adapter 28 at the end thereof adjacent the ratchet head 14. The adapter 28 includes a socket-like recess 30 conforming with and drivingly engaged with the output drive 20 with a recess in the socket 30 receiving the spring detent 22. The other end of the adapter 28 includes a cylindrical extension 32 which is telescopically received in the end of the tubular body 26 as illustrated in FIG. 3 with a transverse shear retaining pin 34 drivingly connecting the extension 32 on the adapter 28 and the tubular body 26 so that in the event excessive torque is being transmitted between the ratchet wrench 12 and the tubular body 26, the pin 34 will be sheared thereby protecting against over torque. During normal operation, the shear pin 34 retains the adapter 28 assembled with respect to the tubular body 26.

Telescoped into and longitudinally adjustable with respect to the tubular body 26 is an elongated externally threaded polygonal shaft 36 which coacts with a broached end portion 38 of the tubular body which has an internal polygonal cross-sectional area 48 corresponding with the exterior of the threaded shaft 36 thereby preventing relative rotation of the threaded shaft 36 in relation to the tubular body 26. However, by broaching the tubular body 26 only at its outer end, the manufacture of the device will be greatly enhanced and this partial broaching also allows the tool to flex and bend slightly thereby eliminating vertical alignment problems which exist when the tubular body is broached into the polygonal cross-sectional configuration on the interior thereof throughout its length.

An adjustment nut or screw 42 is rotatably mounted and fixedly mounted to the outer broached end of the tubular body 26 with the adjustment nut or screw 42 being generally cylindrical and provided with a knurled external surface 44 and an interior angled bearing surface 46 engaging the correspondingly shaped outer end of the broached end 38 of the tubular body 26 as illustrated in FIG. 3. The outer end of the adjustment nut or screw 42 is internally threaded as at 48 for screw threaded engagement with the threaded corner portions of the polygonal shaft 36 so that upon rotation of the adjustment nut or screw 42, the threaded shaft 36 will be extended or retracted in relation to the tubular body 26.

Figures 6, 7, 8, 9, 10, 11:
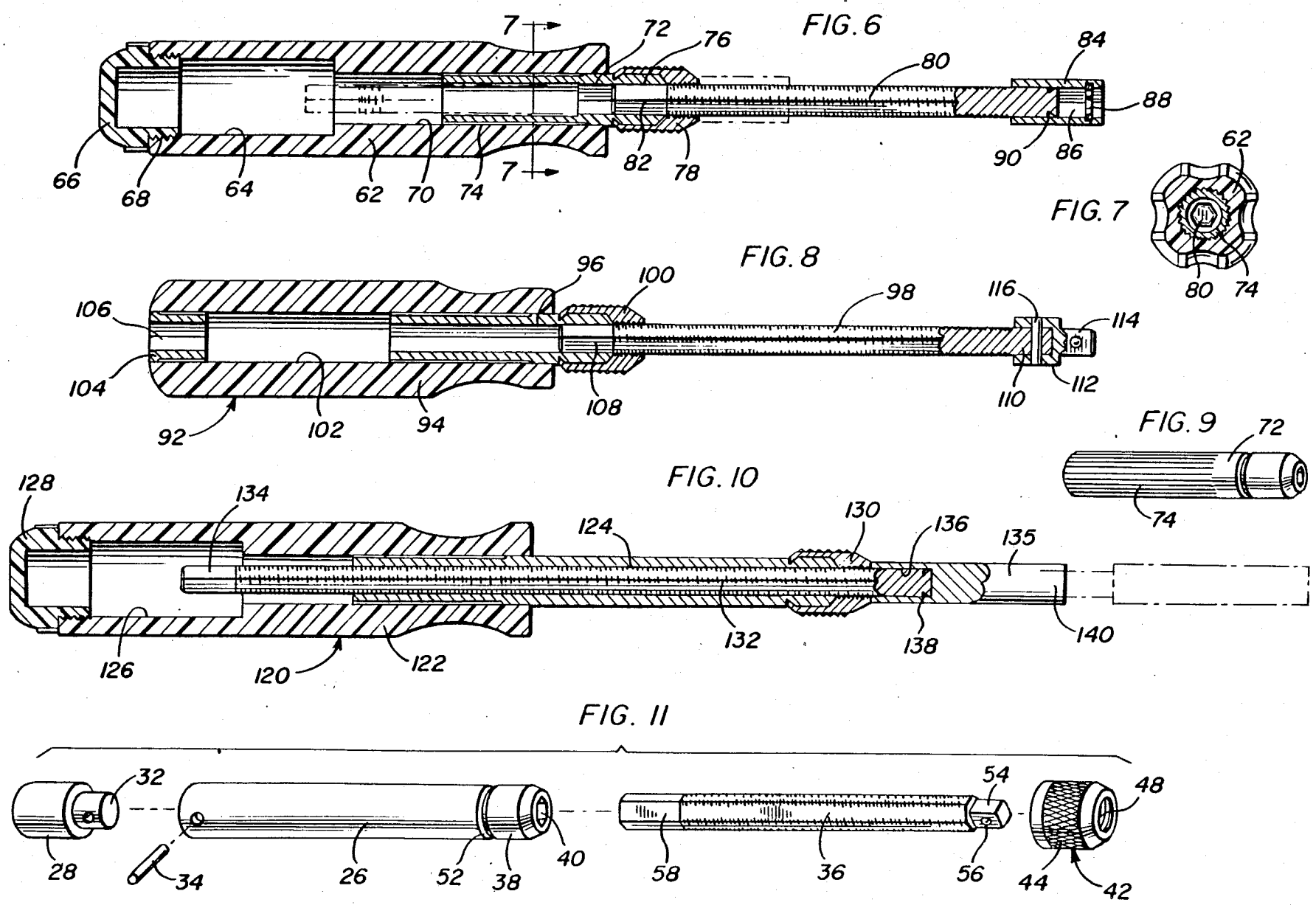
FIG. 6 is a longitudinal sectional view of the screwdriver illustrating one embodiment of a tool holder on the outer end of the adjustable threaded shaft.
FIG. 7 is a transverse, sectional view taken substantially upon a plane passing along section line 7—7 on FIG. 6 illustrating further structural details of the handle and tubular body.
FIG. 8 is a longitudinal sectional view of a screwdriver incorporating the present invention therein disclosing another type of tool holder on the outer end of the adjustable shaft.
FIG. 9 is a perspective view of the tubular body illustrating its specific structure.
FIG. 10 is a sectional view of the screwdriver with a longer tubular body incorporated therein to enable a longer adjustable shaft to be utilized.
FIG. 11 is an exploded group perspective view of the tubular body, adapter, adjustable shaft and adjustment nut or screw.

For retaining the adjustment nut or screw 42 on the broached end of the tubular body 26, the inner end 50 of the cylindrical adjustment nut or screw 42 is rolled into an angled groove 52 formed in the exterior surface of the tubular body 26 intermediate the length of the broached end portion as illustrated in FIG. 3. The outer end of the threaded shaft is provided with a square output drive 54 having a spring detent 56 on which a socket of desired size and configuration can be easily installed and interchanged when desired. The inner end of the threaded shaft 36 is provided with an unthreaded portion 58 which is the same in cross-sectional shape and configuration as the remainder of the shaft 36 but which will not pass out through the internal threads 48 on the adjustment nut or screw 42. This assures that the adjustable threaded shaft 36 cannot be disassembled with respect to the tubular body 26 and the adjustment nut or screw 42 that is permanently connected thereto by the rolled edge portion 50 being rolled into the angled groove 52 with the unthreaded portion 58 being positioned inwardly of the internal threads 48 during assembly so that these three components then become a permanent arrangement. Also, the adapter 28, when used, becomes a permanent part of the tubular body 26 except that the shear pin 34 can be replaced if it becomes sheared due to over torqueing of the socket extension and threaded shaft by the ratchet wrench 12. FIG. 11 illustrates an exploded perspective assembly of the aforementioned components illustrating the position and orientation of these components prior to their assembly.

FIGS. 5–10 illustrate screwdrivers with the variable length feature of the present invention incorporated therein with the screwdriver in FIGS. 5–7 being designated by numeral 60 and including a handle 62 having a hollow compartment 64 in one end thereof for screwdriver bits or the like and a closure cap 66 is provided for the compartment 64 with a screw threaded connection 68 being provided between the cap 66 and the handle 62. The other end of the handle 62 is provided with a longitudinal bore 70 which telescopically receives and is fixedly attached to a tubular body 72, the structure of which is best illustrated in FIG. 9 and which includes longitudinal serations 74 throughout the major portion of the length thereof for permanently biting into and forming a fixed attachment to the interior surface of the bore 70 thereby combining the handle 62 and the tubular body 72 into a fixed and rigid structure. The end portion of the tubular body 72 is broached as at 76 and mounts an adjustment nut or screw 78 which is identical to the adjustment screw or nut 42 disclosed in FIGS. 1-4. A threaded shaft 80 with an unthreaded portion 82 is adjustably received in the tubular body 72 for longitudinal movement in response to rotation of the adjustment nut or screw 78. The outer end of the threaded shaft 80 is provided with a tubular tool holder 84 in the form of a tubular sleeve having a non-circular innerbore 86 and a split retaining spring ring 88 which engages in an annular groove in a screwdriver bit or other tool bit. The tool holder or sleeve 84 is secured to the end of the threaded shaft 80 by deforming a portion of the sleeve 84 into an angled groove 90 formed in the outer end of the threaded shaft 80 thus enabling easy interchange of tools, screwdriver bits and the like and a secure driving connection between the shaft 80 and the tool mounted in the tool holder.

FIG. 8 discloses a screwdriver generally designated by the numeral 92 which is similar in many respects to the screwdriver in FIGS. 5 and 6 insofar as the relationship between the handle 94, tubular body 96, threaded polygonal shaft 98 and adjustment nut or screw 100 are concerned. The tubular body 96 may be broached to provide a polygonal area on the outer end portion thereof or may be broached throughout its length. The handle 94 is provided with a bore having an adapter 104 inserted into the end thereof with the adapter 104 including a square socket 106 to receive the drive output of a ratchet wrench, extension or the like. The adjustable shaft operates in the same manner and includes an unthreaded portion 108 at its inner end with the outer end thereof having a cylindrical portion 110 receiving a cylindrical sleeve 112 having an output drive 114 on one end thereof and a shear pin 116 securing the sleeve 112 to the cylindrical end portion 110 of the adjustable shaft 98 thereby providing over torque protection. The output drive 114 may receive a socket, further extension or the tool depending upon the use for the device.

FIG. 10 illustrates another variation of screwdriver structure generally designated by numeral 120 which includes a handle 122, an elongated tubular body 124 fixedly secured thereto in the same manner as the other screwdriver embodiments with a bit holder compartment 126 being provided in the handle 122 and provided with a closure cap 128 in a manner similar to the closure cap 66 in FIG. 6. As illustrated, the tubular body 124 is substantially longer than the tubular bodies in FIGS. 6 and 8 and has an adjustment nut or screw 130 at the outer end thereof mounted in the same manner as the other embodiments of the invention for extending and retracting an elongated threaded shaft 132 having an unthreaded inner end portion 134 and having a tool holder 135 attached to its outer end by virtue of a polygonal socket 136 secured to the polygonal end of the shaft 132 by deforming a portion of the socket wall 136 into an angled groove 138. The tool holder 135 includes a magnetic tip 140 of any desired length to enable magnetic force to be used to manipulate fasteners or other items subject to magnetic attraction.

The variable length socket extension provides effective access to fasteners such as bolts, nuts and the like located in confined areas especially in aircraft structures where maintenance requires that a socket wrench gain access to such fasteners. The extension may be constructed in various sizes, diameters and lengths so that it may be used in all types of general maintenance including aircraft, automotive and the like. The variable length socket extension can be used by itself and with various types of drive assemblies including ratchet wrenches and the like and may be used with other fixed length extensions to obtain various extension arrangements. By placing the variable length extension next to the ratchet head, the variable length extension can be adjusted without the removal of any of the socket accessories being used which is of substantial value when working in limited and congested areas.

The variable length screwdriver is also multipurpose and is especially useful in small or limited quantity tool kits. The ability to increase and decrease the length of the screwdriver and the interchangeable screwdriver bits or tool components renders the screwdriver ideally suited for minimum quantity tool kits for automobile, boat, aircraft and for any personal and professional use in all areas of maintenance.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A variable length tool comprising a tubular body having means connected thereto for exerting rotational torque thereon, said tubular body including a lingitudinal bore extending therethrough with at least a portion of the bore being of polygonal cross-sectional configuration, an elongated, externally threaded shaft received in said bore and being of corresponding polygonal cross-sectional configuration to prevent relative rotation between the tubular body and shaft, an internally threaded adjustment nut in threaded engagement with said shaft, means rotatably journalling the nut from the end of the tubular body to extend and retract the shaft in relation to the tubular body when the adjustment nut is rotated, the end portion of the threaded shaft oriented interiorly of the tubular body including an unthreaded portion that will not pass through the adjustment nut thereby precluding disassembly of the shaft from the tubular body, and means at the opposite end of the threaded shaft for detachable connection with a work engaging tool, said adjustment nut being substantially cylindrical in configuration and including a cylindrical recess rotatably journalled on a cylindrical end portion of the tubular body, said tubular body having an angled groove adjacent the end portion thereof with the inner end of the adjustment nut extending into said groove for rotatably securing the nut to the tubular body, the end of the tubular body received in the nut including an angled end bearing surface, said adjustment nut including an angled bearing surface engaged with the angled bearing surface on the tubular body to stabilize and secure the adjustment nut in relation to the tubular body.

2. The structure as defined in claim 1 wherein said tubular body is in the form of a socket extension having means thereon opposite the adjustment nut for engagement with the output drive of a ratchet wrench.

3. The structure as defined in claim 5 wherein the means engaged with the output drive of the ratchet wrench includes an adapter drivingly connected with the output drive of the ratchet wrench and including a cylindrical extension received in the end of the tubular body and secured therein by a transverse shear pin which protects against excessive rotational torque being imparted to the socket extension.

4. The structure as defined in claim 1 wherein said means for imparting torque to the tubular body includes a screwdriver handle, said tubular body including external ribs and grooves thereon, said screwdriver handle including a bore fixedly securing the screwdriver handle to the exterior of the tubular body.

5. The structure as defined in claim 4 wherein said handle includes a hollow bit compartment at the end thereof remote from the tubular body, a closure cap for said compartment to enable bits to be effectively stored therein.

6. The structure as defined in claim 4 wherein said screwdriver handle includes a female adapter in the end thereof remote from the tubular body with the adapter including a socket for receiving an output drive of a wrench.

7. The structure as defined in claim 1 wherein said means at the end of the threaded shaft for connecting with a work engaging tool includes a cylindrical shaft portion and sleeve thereon with an output drive and a shear pin extending transversely of the sleeve and cylindrical shaft portion to prevent over torque transmission from the shaft to the output drive.

8. The structure as defined in claim 1 wherein said means at the end of the shaft for connecting with a work engaging tool includes a sleeve with internal snap ring enabling assembly and disassembly of bits having an external groove.

9. The structure as defined in claim 1 wherein said means at the end of the shaft for connecting with a work engaging tool includes an elongated permanent magnet.

10. The structure as defined in claim 4 wherein said adjustment nut is located closely adjacent the end of the screwdriver handle.

11. The structure as defined in claim 4 wherein said tubular body extends substantially beyond the end of the screwdriver handle with the adjustment nut being remotely positioned with respect to the end of the screwdriver handle.

* * * * *